US011331777B2

(12) United States Patent
Glockseisen et al.

(10) Patent No.: US 11,331,777 B2
(45) Date of Patent: May 17, 2022

(54) PIVOTING PLIERS JAW IN A DESIGN COMPRISING PLATES AND CRIMPING PLIERS COMPRISING A PIVOTING PLIERS JAW

(71) Applicant: WEZAG GmbH Werkzeugfabrik, Stadtallendorf (DE)

(72) Inventors: Thomas Glockseisen, Duesseldorf (DE); Roman Zinser, Neustadt (DE)

(73) Assignee: WEZAG GMBH & CO. KG, Stadtallendorf (DE)

( * ) Notice: Subject to any disclaimer, the term of this patent is extended or adjusted under 35 U.S.C. 154(b) by 445 days.

(21) Appl. No.: 16/377,551

(22) Filed: Apr. 8, 2019

(65) Prior Publication Data

US 2019/0314966 A1 Oct. 17, 2019

(30) Foreign Application Priority Data

Apr. 11, 2018 (EP) ..... 18166739

(51) Int. Cl.
*H01R 43/042* (2006.01)
*B25B 27/14* (2006.01)
*B25B 7/04* (2006.01)

(52) U.S. Cl.
CPC ..... *B25B 27/146* (2013.01); *B25B 7/04* (2013.01); *H01R 43/042* (2013.01)

(58) Field of Classification Search
CPC .. B25B 7/12; B25B 7/146; H01R 43/042–045
(Continued)

(56) References Cited

U.S. PATENT DOCUMENTS 2,478,728 A * 8/1949 Ward ..... B25B 7/123 81/367
4,870,876 A * 10/1989 Rodriquez ..... B25B 7/02 81/426.5

(Continued)

FOREIGN PATENT DOCUMENTS

DE 2521378 A1 * 11/1976 ..... H01R 43/042
DE 198 02 287 C1 12/1998

(Continued)

OTHER PUBLICATIONS

Machine translation of DE 19924086 A1, Retrieved from Espacenet Sep. 30, 2021, 10 Pages. (Year: 2000).*

(Continued)

*Primary Examiner* — Gregory D Swiatocha
(74) *Attorney, Agent, or Firm* — Thomas | Horstemeyer, LLP

(57) ABSTRACT

A pivoting pliers jaw (18) having a design including plates for manually actuated crimping pliers (1). The pivoting pliers jaw (18) which includes a supporting plate (23) at which on both sides pliers jaw plates (25) are held. The pliers jaw plates (25) form an accommodation for a die insert or support the accommodation. According to the invention the pivoting pliers jaw (18) is L-shaped. Bolts (27, 28) for mounting the pliers jaw plates (25) to the supporting plate (23) are arranged in a way such that a connecting axis of the longitudinal axes of the bolts (27, 28) have an orientation approximately perpendicular to a supporting plane (36) for the effective crimping force.

7 Claims, 9 Drawing Sheets

(58) Field of Classification Search
USPC ..... 72/409.11, 409.12; 81/367, 368, 369, 81/370, 371, 372, 373
See application file for complete search history.

(56) References Cited

U.S. PATENT DOCUMENTS

| | | | | |
|---|---|---|---|---|
| 5,267,464 | A * | 12/1993 | Cleland | B25B 7/12 29/237 |
| 6,053,025 | A | 4/2000 | Beetz et al. | |
| 6,612,206 | B1 * | 9/2003 | Heggemann | B25B 7/12 81/342 |
| 8,590,352 | B2 * | 11/2013 | Bowles | G01B 3/34 72/31.01 |
| 2003/0066186 | A1 * | 4/2003 | Lu | H01R 43/042 29/748 |
| 2009/0145269 | A1 * | 6/2009 | Cleland | B26B 17/02 81/367 |

FOREIGN PATENT DOCUMENTS

| | | | | |
|---|---|---|---|---|
| DE | 19924086 | A1 * | 12/2000 | B25B 27/10 |
| DE | 20 2006 012 869 | U1 | 1/2008 | |
| DE | 202010008988 | U1 * | 2/2012 | H01R 43/042 |
| DE | 20 2013 102 833 | U1 | 11/2014 | |

OTHER PUBLICATIONS

Machine translation of DE 202010008988U1, Retrieved from Espacenet Sep. 30, 2021, 5 Pages. (Year: 2012).*
Machine translation of DE 2521378A1, Retrieved from Espacenet Sep. 30, 2021, 4 Pages. (Year: 1976).*
WEZAG GmbH Werkzeugfabrik, Die Bibliothek der Technik 342, Verlag Moderne Industrie, ISBN 978-3-68236-027-7: "Crimptechnik, production of process reliable connections of electric conductors and plugs" (Oct. 12, 2011).
Product catalogue of the WEZAG GmbH Werkzeugfabrik, publication No. 10/11: "Tools for professional application", Nov. 1, 2011.

* cited by examiner

PIVOTING PLIERS JAW IN A DESIGN COMPRISING PLATES AND CRIMPING PLIERS COMPRISING A PIVOTING PLIERS JAW

CROSS REFERENCE TO RELATED APPLICATIONS

This application claims priority to co-pending German Patent Application No. EP 18 166 739.5-1201 filed Apr. 11, 2018.

FIELD OF THE INVENTION

The invention relates to a pivoting pliers jaw in a plate design which is used in manually actuated crimping pliers. By means of the crimping pliers it is possible to induce a pressing or crimping of a workpiece by a manual actuation of hand levers. Here, crimping pliers in particular serve for producing a permanent mechanical connection and an electric contact. This is preferably provided by crimping a plug to a cable or to an electric conductor of any design. Dependent on the profile of the used dies it is possible to execute different crimping processes with the crimping pliers. It might e.g. be a closed crimp where the conductor is inserted into a closed crimping zone of a plug or into a closed sleeve and where the conductor is crimped under a plastic deformation of the crimping zone or sleeve. However, it is also possible that an open crimp is produced where the plug comprises an open crimping zone into which the conductor can be inserted from above. To mention only some examples (which are not intended to limit the invention) by means of the present crimping tool it is possible to crimp

- cable shoes according to DIN 4623,
- aluminum connectors according to DIN 46329,
- pressed cable shoes made of aluminum according to DIN 48201,
- squeezed cable shoes according to DIN 46234,
- pin cable shoes according to DIN 46230 or
- connectors, plugs or cable shoes for establishing a connection with a cable or conductor as described in the product catalogue of the WEZAG GmbH Werkzeugfabrik "Tools for professional application" with the publication no. 10/11.

The produced crimp might e.g. be a closed crimp embodied as six-edges crimp or hexagonal crimp, four-edges crimp, B-crimp, trapezoidal crimp, modified trapezoidal crimp, oval crimp, mandrel crimp or two-mandrel crimp. An open crimp might e.g. be embodied as V-crimp or B-crimp, rolled crimp or double-rolled crimp.

Additional to the production of an electric connection between a cable or conductor and a plug it is possible that a mechanical connection is produced by means of a so-called insulation crimp. Here, a closed insulation crimp or open insulation crimp (in particular V-crimp, B-crimp, O-crimp or OV-crimp) can be used. For further information

- concerning the design of generic crimping pliers,
- concerning possible fields of uses of the generic crimping pliers and/or
- concerning different possible types of crimping connections which can be produced by means of the generic crimping pliers reference is made to the publication "Crimptechnik, production of process reliable connections of electric conductors and plugs" of the WEZAG GmbH Werkzeugfabrik, Die Bibliothek der Technik 342, Verlag Moderne Industrie, ISBN 978-3-68236-027-7.

BACKGROUND OF THE INVENTION

The publication DE 19 802 287 C1 corresponding to U.S. Pat. No. 6,053,025 A discloses crimping pliers comprising a fixed pliers part. In the fixed pliers part a fixed hand lever is integrally connected to a fixed pliers jaw. Similar to scissors a pivoting pliers jaw is supported for being pivoted by the fixed pliers part. The pivoting pliers jaw comprises a supporting plate as well as two pliers jaw plates. The pliers jaw plates are arranged with an overlap on both sides of the supporting plate. In the region of the overlap the pliers jaw plates are held by two bolts at the supporting plate. The supporting plate protrudes on the side remote from the pliers head out of the overlapping regions. In the protruding end region the supporting plate is connected for being pivoted to a movable hand lever. The movable hand lever is supported for being pivoted via a pressure lever under the establishment of a toggle lever drive at the fixed hand lever. On the side facing towards the pliers head the pliers jaw plates protrude from the overlapping regions. Between the pliers jaw plates an accommodating space of an accommodation for a die insert is formed. The die insert comprises a die plate and two supporting elements. The die plate forms a flange being arranged in the accommodating space of the accommodation and a portion protruding from the pliers jaw plates towards the fixed pliers jaw. The outer front side of the protruding portion of the die plate forms a plurality of dies. In the transitional region between the flange and the protruding portion the die plate comprises bores. The bores have a distance from each other in a supporting plane. The supporting plane has an orientation transverse to the crimping force acting between the dies. Supporting elements embodied as transverse bolts are fixed in the bores or housed therein with an interference fit. The transverse bolts protrude on both sides from the die plate. On the side facing towards the fixed pliers jaw the pliers jaw plates comprise recesses having open edges. The recesses might have the shape of a half cylinder or might have a polygonal, semi-open cross section. When the die insert has been inserted into the accommodation formed by the pliers jaw plates, the transverse supports are accommodated in the recesses having an open edge with an accurate fit and secured against a displacement. In this way a force transfer is provided between the transverse supports and the recesses having open edges both in the direction of the crimping force as well as transverse to the crimping force. In the region of the flange both the pliers jaw plates as well as the die insert might comprise through bores or a threaded bore by which it is possible to mount the die insert at the pliers jaw plates by use of a mounting screw or a bolt. For mounting the pliers jaw plates to the supporting plate the bolts are here arranged on a connecting axis which has an orientation approximately parallel to the longitudinal extension of the movable hand lever. The connecting axis has an orientation with a pointed angle of approximately 20° relative to the supporting plane. In a corresponding way, the main extensional direction of the overlaps of the supporting plate and the pliers jaw plates has an orientation parallel to the hand levers and/or under the aforementioned pointed angle relative to the supporting plane.

The publication DE 20 2006 012 869 U1 discloses crimping pliers comprising a fixed pliers part which integrally forms a fixed hand lever and a fixed pliers jaw. A movable pivoting pliers jaw has a design comprising plates and is linked by a pivot joint for being pivoted to the fixed pliers part. The pivoting pliers jaw comprises a supporting plate and a pliers jaw plate fixed thereto. The pliers jaw plate forms an accommodation for a die insert. By a pivot joint the movable hand lever is linked to the supporting plate. The movable hand lever is additionally linked by a pressure lever to the fixed hand lever. For connecting the supporting plate to the pliers jaw plate two mounting bolts secured by a securing ring are used. The pliers jaw plate has approximately a triangular shape. In the region of one side of the triangle the accommodation for the die insert is formed. A neighboring side of the triangle defines the outer contour of the pivoting pliers jaw in the region of the pliers head. In the region of the third side of the triangle the mounting bolt for mounting the supporting plate to the pliers jaw plate is provided. A connecting axis of the longitudinal axes of the mounting bolts has an orientation parallel to this third side. Here, the first side of the triangle for forming the accommodation for the die insert and the connecting axis form an angle of approximately 120°.

The publication DE 20 2013 102 833 U1 discloses the use of a corresponding pivoting pliers jaw for a crimping tool which is driven by external energy, here electro-hydraulically driven.

SUMMARY OF THE INVENTION

The invention bases on the object to propose a pivoting pliers jaw which is in particular improved with respect to

- the mechanical strength,
- the design of the constructional space of the pivoting pliers jaw and the crimping pliers,
- the constructional space of the pivoting pliers jaw and the crimping pliers and/or
- the number of constructional elements.

Furthermore, the invention bases on the object to propose crimping pliers being improved in a corresponding way.

The invention proposes a pivoting pliers jaw being manufactured in a construction comprising plates. Plates of the required thicknesses and the required mechanical properties can be supplied at low costs as semi-finished products. By means of cheap known manufacturing to processes it is possible to bring the plates into the required dimensions and geometries. The inventive pivoting pliers jaw is used in manually actuated crimping pliers as described in the beginning.

The pivoting pliers jaw comprises a supporting plate and at least one pliers jaw plate. It is possible that the pliers jaw plate directly forms an accommodation for a die insert. However, it is also possible that the pliers jaw plate supports an accommodation of this type. In this case it is also possible that the accommodation is exchangeably held by the pliers jaw plate. The pliers jaw plate defines a supporting plane of the accommodation for supporting a crimping force biasing the die insert. Preferably, the supporting plane has an orientation perpendicular to the crimping force or forms at the most a pointed angle of less than 30°, less than 20° or less than 15° or less than 10° or even less than 5° relative to the plane which has an orientation perpendicular to the crimping force.

The pliers jaw plate is arranged with an overlap on one side of the supporting plate. Preferably, the pliers jaw plate directly contacts the supporting plate in the region of the overlap. In the region of the overlap the pliers jaw plate is held by (exactly) two bolts at the supporting plate. For this purpose the pliers jaw plate and the supporting plate might comprise aligned bores. Bolts can be accommodated in the aligned bores. It is possible that a screwed bolt is used for holding the pliers jaw plate at the supporting plate. However, it is also possible that the pliers jaw plate is held at the supporting plate by a pin-like bolt or cylindrical bolt which is arranged in the bores of the pliers jaw plate and the supporting plate under the establishment of an interference fit or a transitional fit. At one side the bolt might comprise a thickening or a securing ring accommodated in a groove and on the other side the bolt might comprise a securing ring housed in a groove. In this case, the pliers jaw plate and the supporting plate might be trapped or caught between the protrusion or the securing ring and the other securing ring.

The invention proposes that an angle between a connecting axis of the longitudinal axis of the bolt and the supporting plane in a pliers jaw plane is 90°±30° (preferably ±20°, ±15°, ±10° or ±5°). With this design the invention leaves the route followed by the prior art that the connecting axis of the longitudinal axes of the bolts necessarily has to be arranged as parallel as possible to the supporting plane. For the embodiments known from the prior art the skilled person assumed that the pivoting pliers jaw should have a design in the type of a straight lever with respect to the application of the crimping force and the forces of the bolts by which the pliers jaw plates are held at the supporting plate and which have an orientation parallel to the crimping force. Here, the crimping force biases one end of the straight lever whereas the force of another bolt biases approximately the middle of the straight lever. For this known design of the arrangement of the bolts for connecting the pliers jaw plate and the supporting plate known from the prior art the skilled person assumed a good accommodation of the force by the bolts and so a high strength. In a surprising way the considerations on which the present invention base have shown that the force conditions are not (substantially) worse or even improved if the inventive angle of approximately 90° between the connecting axis of the longitudinal axes of the bolts and the supporting plane is chosen.

If it is e.g. assumed that for an embodiment of the invention the points of introduction of the crimping force and the two forces of the bolts (due to the chosen angle between the connecting axis of the longitudinal axes of the bolts and the supporting plane) are arranged at the corners of a square, the maximum of the forces of the bolts being applied upon the bolts due to the crimping force is only the half of the effective force in the case that the crimping force is introduced into an end region of a straight lever which is supported in the middle and in the other end region by the bolts. Accordingly, the inventive design leads to a reduction of the mechanical bias of the involved constructional elements.

On the other hand, the arrangement of the two bolts known from the prior art with an orientation of the connecting axis of the longitudinal axes parallel to the supporting plane respectively the hand levers leads to the result that the pivoting pliers jaw has a comparatively large constructional dimension in the direction of the longitudinal axis of the crimping pliers which in some cases might be reduced by the inventive angle.

Finally, by use of the angle it is also possible to extend the design options and also to extend the options for influencing the optical appearance of the crimping pliers.

The pliers jaw plate has an L-shape. The two legs of the L are here built by a mounting leg and a pliers jaw leg. The mounting leg here preferably serves for mounting the pliers jaw plate to the supporting plate. The pliers jaw leg preferably serves for the formation of the actual pliers jaw plate and for supporting the accommodation for the die insert or for forming the same.

One bolt extends through the transitional region where the mounting leg transits to the pliers jaw leg (so in the corner region of the L). Alternatively or cumulatively it is possible that a bolt extends through the free end region of the mounting leg. This results in a particularly compact design wherein the material of the pliers jaw plate is used in an optimal way.

It is possible that additional to the bores for the two bolts for mounting the pliers jaw plate to the supporting plate (and any other recesses or bores for the die insert) the pivoting pliers jaw comprises an additional recess, a bearing bolt or bearing stud or bearing lug. In the region of the recess, of the bearing bolt, of the bearing lug or of the bearing stud a pivot joint of the pliers jaw is formed. Said in different words, for this embodiment the pivot joint for bearing the pivoting pliers jaw against a fixed pliers part or a fixed pliers jaw is arranged remote from the two bolts for mounting the pliers jaw plate to the supporting plate.

For a particular proposal of the invention the pivot joint coincides with a bolt for mounting the pliers jaw plate to the supporting plate. In this case the bolt which extends through the free end region of the mounting leg of the pliers jaw plate is a pivot bolt of the crimping pliers by which the pivoting pliers jaw is supported for being pivoted at the fixed pliers jaw. Accordingly, it is possible to use the bolt in a multi-functional way: on the one hand the bolt forms the pivot bolt for supporting the pivoting pliers jaw for being pivoted relative to the fixed pliers jaw. On the other hand the bolt is used for mounting the pliers jaw plate to the supporting plate. By these measures a particularly compact embodiment and a reduction of the number of associated constructional element can be achieved.

Another aspect of the invention cares for the arrangement of a die insert at the pivoting pliers jaw. Generally, any accommodation known from the prior art might be used for the die insert at the inventive pivoting pliers jaw. For a particular proposal of the invention the accommodation of the pliers jaw plate comprises two accommodations for supporting elements of a die insert. The accommodations have a convex shape and are arranged (in a projection into the supporting plane) with a distance from each other. By the accommodations and supporting elements of a die insert arranged in the accommodations it is possible to transfer at least a component of a crimping force biasing the die insert which has an orientation vertical to the supporting plane from the die insert to the pliers jaw plate. Additionally, it is possible that a force having an orientation parallel to the supporting plane is supported between the accommodation and the supporting elements. To mention only one example for this embodiment, convex accommodations can be provided by recesses having an open edge whereas the supporting element can be embodied as transverse bolts protruding from a die plate as described in the publication DE 19 802 287 C1. With respect to further details reference is made to the publication DE 19 802 287 C1. The disclosure of the publication DE 19 802 287 C1 is made to the subject of the present disclosure with respect to the mounting and the support of the die insert to or at the pliers jaw plates.

Alternatively or cumulatively it is possible that the accommodation of the pliers jaw plate comprises a bore for a mounting screw. By the mounting screw it is possible to mount the die insert to the pivoting pliers jaw. Nevertheless, for this embodiment the actual accommodation of large crimping forces can be provided by the support of a supporting element of a die insert at a convex accommodation of the pliers jaw plate.

There are a lot of options for dimensioning the pivoting pliers jaw (in particular with respect to the longitudinal extension of the mounting leg). For one proposal the longitudinal extension of to the mounting leg of the pliers jaw plate is larger than a half of the transverse extension of the pliers head (in particular larger than the half of the transverse extension of the pliers head in the region of the pivot joint by which the pivoting pliers jaw is supported for being pivoted at the fixed pliers jaw).

It is generally possible that only one pliers jaw plate is held at the supporting plate. For one proposal pliers jaw plates are arranged on both sides of the supporting plate. The two pliers jaw plates might have the same or differing geometries. In this case, the two pliers jaw plates are held by the two bolts at the supporting plates. The bolts are held in the region of (preferably corresponding) overlaps of the two pliers jaw plates with the supporting plate.

By the use of two pliers jaw plates it is possible to use a symmetrical design of the pivoting pliers jaw. Here, the two pliers jaw plates might be arranged symmetrically to a middle plane of the pliers head. The two pliers jaw plates might then together be used for forming or supporting the accommodation for the die insert. For one proposal the thickness of the supporting plate in the region of the overlaps with the pliers jaw plates corresponds (with a transitional fit or a clearance fit) to the thickness of a die insert (in particular in the region of a flange of a die plate). The thickness of the supporting plate also defines an extension of an accommodating space of the accommodation established between the pliers jaw plates. It is possible to insert the flange of the die insert into the accommodating space. It is possible that in the region of the flange the die insert is two-dimensionally guided or supported between the pliers jaw plates. An additional support can be provided by a mounting screw and/or the supporting elements supported in the convex accommodations.

A pivoting pliers jaw might be integrated into any arbitrary crimping pliers having an arbitrary drive mechanism. For a particular proposal the crimping pliers comprise a toggle lever drive. The toggle lever drive is actuated by the hand levers. It is also possible that a part of one of the hand levers forms a toggle lever of the toggle lever drive (cp. e.g. the prior art DE 19 802 287 C1 mentioned in the beginning). In this case, one toggle lever of the toggle lever drive is to linked to the supporting plate. For this purpose the supporting plate might comprise a bore which forms a bearing lug for a pivot bolt. However, it is e.g. also possible that the supporting plate forms a bore for a pivot bolt.

Within the frame of the invention there are a lot of options for the choice of the geometry of the pivoting pliers jaw and the supporting plate as well as the at least one pliers jaw plate. For one proposal in a plan view onto the pliers head plane the pivoting pliers jaw (which is formed by the supporting plate and the at least one pliers jaw plate) generally has the shape of a T. A first horizontal leg of the T is formed by the pliers jaw leg of the pliers jaw plate. A second horizontal leg of the T is formed by the supporting plate. In the free end region of the second horizontal leg of the T then the pivot joint is formed where the pivoting pliers jaw is actuated by the toggle lever drive. In the region of the vertical leg of the T the overlap of the supporting plate with the pliers jaw plate (here the mounting leg of the pliers jaw plate) is arranged. In the free end region of the vertical leg of the T preferably the pivot joint is arranged by which the pivoting pliers jaw is supported for being pivoted at the fixed pliers jaw.

For another proposal the supporting plate comprises a mounting leg and a pivoting arm leg. Here, the mounting leg and the pivoting arm leg are arranged in an L-shape. The pivoting arm leg of the supporting plate is arranged approximately parallel to the pliers jaw leg of the at least one pliers jaw plate. Here, approximately parallel means that the pivoting arm leg of the supporting plate and the pliers jaw leg of the at least one pliers jaw plate form an angle relative to each other of less than 30°, less than 20° or less than 10°. In this case a pivot joint is arranged in the free end region of the pivoting arm leg. By this pivot joint the pivoting pliers jaw is supported for being pivoted at the pliers head, a fixed pliers part or one of the hand levers.

Advantageous developments of the invention result from the claims, the description and the drawings. The advantages of features and of combinations of a plurality of features mentioned at the beginning of the description only serve as examples and may be used alternatively or cumulatively without the necessity of embodiments according to the invention having to obtain these advantages. Without changing the scope of protection as defined by the enclosed claims, the following applies with respect to the disclosure of the original application and the patent: further features may be taken from the drawings, in particular from the illustrated designs and the dimensions of a plurality of components with respect to one another as well as from their relative arrangement and their operative connection. The combination of features of different embodiments of the invention or of features of different claims independent of the chosen references of the claims is also possible, and it is motivated herewith. This also relates to features which are illustrated in separate drawings, or which are mentioned when describing them. These features may also be combined with features of different claims. Furthermore, it is possible that further embodiments of the invention do not have the features mentioned in the claims.

The number of the features mentioned in the claims and in the description is to be understood to cover this exact number and a greater number than the mentioned number without having to explicitly use the adverb "at least". For example, if an element is mentioned, this is to be understood such that there is exactly one element or there are two elements or more elements. Additional features may be added to these features, or these features may be the only features of the respective product.

The reference signs contained in the claims are not limiting the extent of the matter protected by the claims. Their sole function is to make the claims easier to understand.

BRIEF DESCRIPTION OF THE DRAWINGS

In the following, the invention is further explained and described with respect to preferred exemplary embodiments illustrated in the drawings.

DETAILED DESCRIPTION

Figure 1:
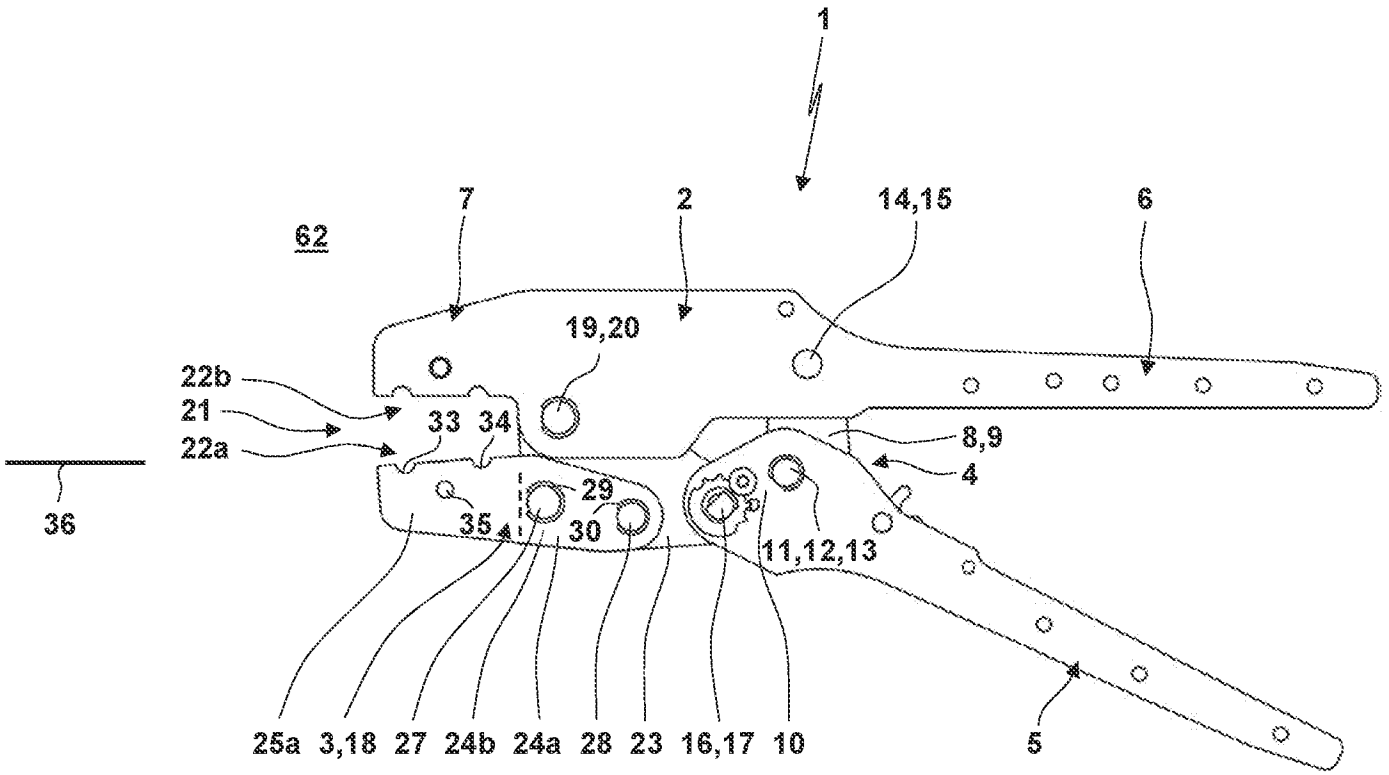
(PRIOR ART) Fig. 1
FIG. 1 shows crimping pliers according to the prior art in a plan view on the pliers head plane.
Figure 2:
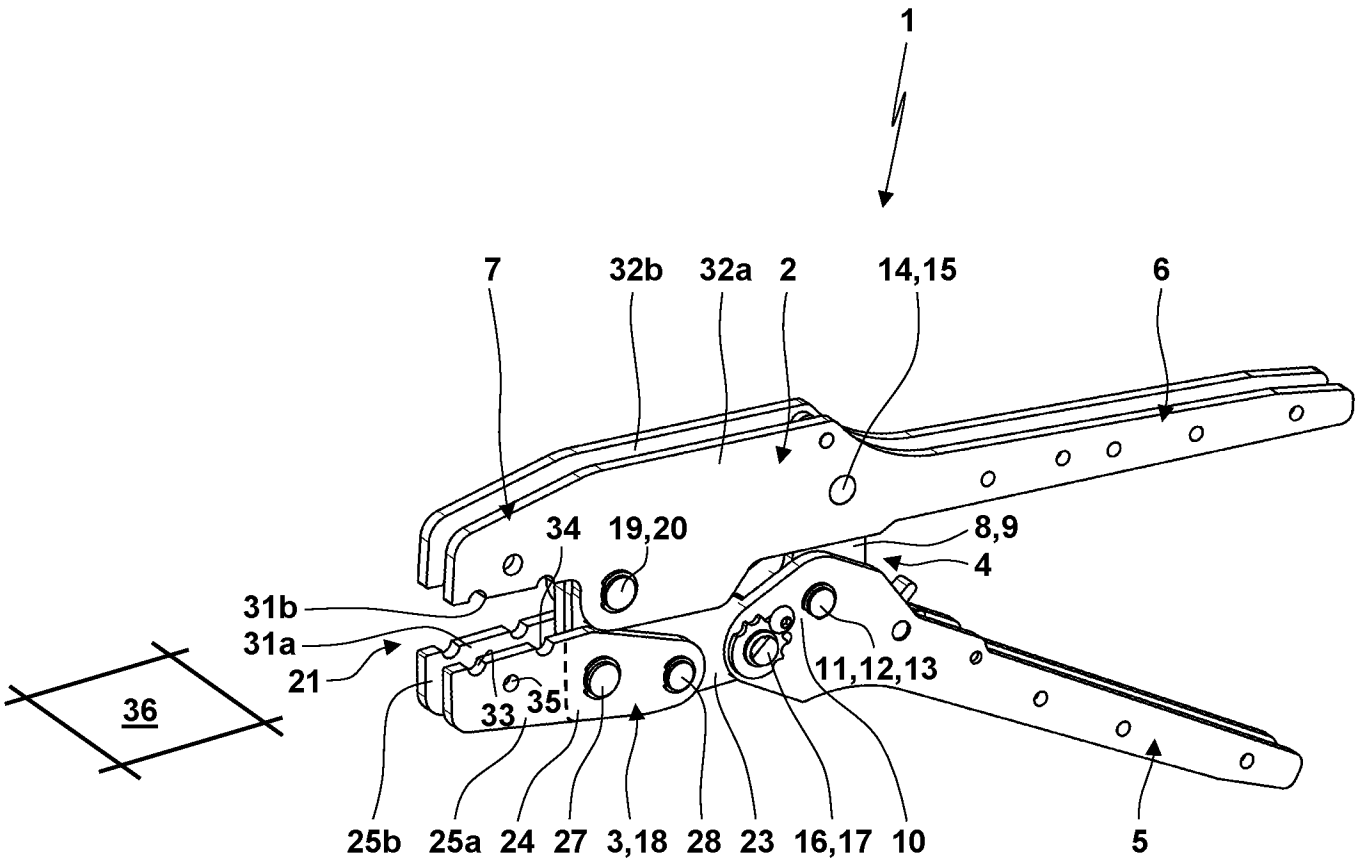
(PRIOR ART) Fig. 2
FIG. 2 shows the crimping pliers of FIG. 1 in a three-dimensional view.

FIGS. 1 and 2 show crimping pliers 1 according to the prior art, in particular according to the publication DE 19 802 287 C1. The crimping pliers 1 comprise a fixed pliers part 2, a movable pliers part 3 and a toggle lever drive 4 which comprises a movable hand lever 5. The fixed pliers part 2 here integrally forms a fixed hand lever 6 and a fixed pliers jaw 7.

The toggle lever drive 4 comprises toggle levers 8, 10. The toggle lever 8 is a pressure lever 9. The toggle lever 10 is formed by the front end region of the movable hand lever 5. The toggle levers 8, 10 are linked for being pivoted to each other by a toggle joint 11. The toggle joint 11 is embodied as a pivot joint 12 comprising a pivot bolt 13. The end region of the toggle lever 8 facing away from the toggle joint 11 is linked by a pivot joint 14 comprising a pivot bolt 15 to the fixed pliers part 2. The toggle lever 10 and so the movable hand lever 5 is linked by a pivot joint 16 comprising a pivot bolt 17 to the movable pliers part 3. The movable pliers part 3 is here embodied as a movable pivoting pliers jaw 18.

The pivoting pliers jaw 18 is supported for being pivoted by the fixed pliers part 2. This is provided by a pivot joint 20 comprising the pivot bolt 19. It is possible to pivot the pivoting pliers jaw 18 towards the fixed pliers jaw 7

- with a pivoting movement of the movable hand lever 5 towards the fixed hand lever 6
- under actuation of the toggle lever drive 4 by an actuation force applied by the toggle lever drive 4 in the region of the pivot joint 16 to the pivoting pliers jaw 18.

In this way a crimping stroke is run through. The fixed pliers jaw 7 and the movable pivoting pliers jaw 18 in the region of a bit of tongues 21 each form recesses 22*a*, 22*b* for a die insert which is here not shown.

The pivoting pliers jaw 18 comprises a supporting plate 23. The pivot joint 20 is partially formed by the supporting plate 23. For this purpose it is possible that the supporting plate 23 comprises a through bore for accommodating the pivot bolt 19. On both sides of the supporting plate 23 pliers jaw plates 25*a*, 25*b* are arranged having overlaps 24*a*, 24*b*. In the region of the overlaps 24*a*, 24*b* the supporting plate 23 and the pliers jaw plates 25*a*, 25*b* are mounted to each other by a first bolt 27 and a second bolt 28. The bolts 27, 28 extend vertically to the extensional plane of the supporting plate 23 and the pliers jaw plates 25*a*, 25*b* as well as to a pliers head plane 62 which corresponds to the drawing plane of FIG. 1. The bolts 27, 28 extend through aligned bores of the supporting plate 23 and of the pliers jaw plates 25. The bolts 27, 28 are here secured by securing rings 29, 30.

For the shown embodiment the supporting plate 23 has approximately a triangular shape (here with rounded corners). The pivot joint 16 is arranged in the region of the in FIG. 1 right corner of the supporting plate 23 so that here the supporting plate 23 comprises a bore. In the region of the in FIG. 1 upper edge the supporting plate 23 comprises the pivot joint 20 so that here the supporting plate 23 comprises a corresponding bore. The overlap 24 is arranged in the region of the part of the triangle which in FIG. 1 is the lower left part. The first bolt 27 is arranged in the left corner of the triangle. The second bolt 28 is arranged approximately in the middle of the base leg of the triangle. For a simplifying assumption a crimping force biases the pivoting pliers jaw 18 in the region of the accommodation 22*b* and the distance of the position of introduction of the crimping force from the first bolt 27 corresponds to the distance of the first bolt 27 from the second bolt 28. Under this assumption the crimping force biasing the pivoting pliers jaw 18 causes a bolt force which biases the first bolt 27, which has an orientation in vertical direction in FIG. 1 and which doubles the crimping force. The second bolt 28 is then biased by a bolt force which approximately equals the crimping force.

In FIG. 2 it can be seen that the accommodations 22 for a die insert are formed by an accommodating space 31*a*, 31*b*. The accommodating space 31*a* is formed in the space intermediate the pliers jaw plates 25*a*, 25*b*. The accommodating space 31*b* is formed in the intermediate space between the two pliers part plates 32*a*, 32*b* of the fixed pliers part 2. It is possible to introduce a flange of a die insert into the accommodating spaces 31 and to guide the same therein and/or to support the same therein, cp. DE 19 802 287 C1. Furthermore, the pliers jaw plates 25*a*, 25*b* comprise (as well as the pliers jaw plates 32*a*, 32*b*) convex accommodations 33, 34 for a supporting element (in particular a transverse bolt) of a die insert as well as a mounting bore 35 by which it is possible to screw a die insert to the pliers jaw plates 25 respectively the pliers part plates 32*a*, 32*b*. Also in this respect for further details reference is made to the publication DE 19 802 287 C1.

The accommodation 22 for the die insert formed by the accommodations 33, 34 for the supporting elements defines a supporting plane 36. The supporting plane 36 has an orientation transverse to the crimping force biasing the pivoting pliers jaw 18 or the orientation differs from this transverse orientation by a maximum of 30°, a maximum of 20°, a maximum of 10° or a maximum of 5°. Preferably, the longitudinal axis of the accommodations 33, 34 respectively of the supporting elements of a die insert arranged therein define the supporting plane 36 or these are arranged therein. It is also possible that the front sides of the pliers jaw plates 25*a*, 25*b* facing towards the bit of tongues 21 define the supporting plane 36.

For the shown embodiment the pliers jaw plates 25*a*, 25*b* (in a simplified consideration) form a straight lever. The crimping force biases an end region of the lever. Approximately in the middle support is provided by the bolt 27. In the other end region the support is provided by the second bolt 28. The pliers jaw plates 25 have an orientation approximately parallel to the supporting plane 36. Furthermore, in the closed position of the hand levers 5, 6 the pliers jaw plates 25 have a longitudinal extension having an orientation approximately parallel to the hand lever 5.

For an embodiment (which with respect to other aspects generally corresponds to the embodiment of FIGS. 1 and 2) the crimping pliers 1 of FIGS. 3 to 6 comprise a pivoting pliers jaw 18 having a different design: in this case the pliers jaw plates 25*a*, 25*b* are L-shaped. The L-shape of the pliers jaw plates 25*a*, 25*b* comprise a mounting leg 37 and a pliers jaw leg 38. The second bolt 28 is here arranged in the free end region of the mounting leg 37. The first bolt 27 is arranged in the connecting region between the mounting leg 37 and the pliers jaw leg 38 (so in the region of the corner of the L). A connecting axis 61 of the longitudinal axes of the bolts 27, 28 in this case has an orientation approximately perpendicular to the supporting plane 36. The corresponding applies to the main extensional direction of the overlaps 24*a*, 24*b*. For this embodiment the supporting plate 23 generally has a design corresponding to the embodiment of FIGS. 1 and 2. So, in a rough approximation the supporting plate 23 has a triangular shape.

Figure 3:
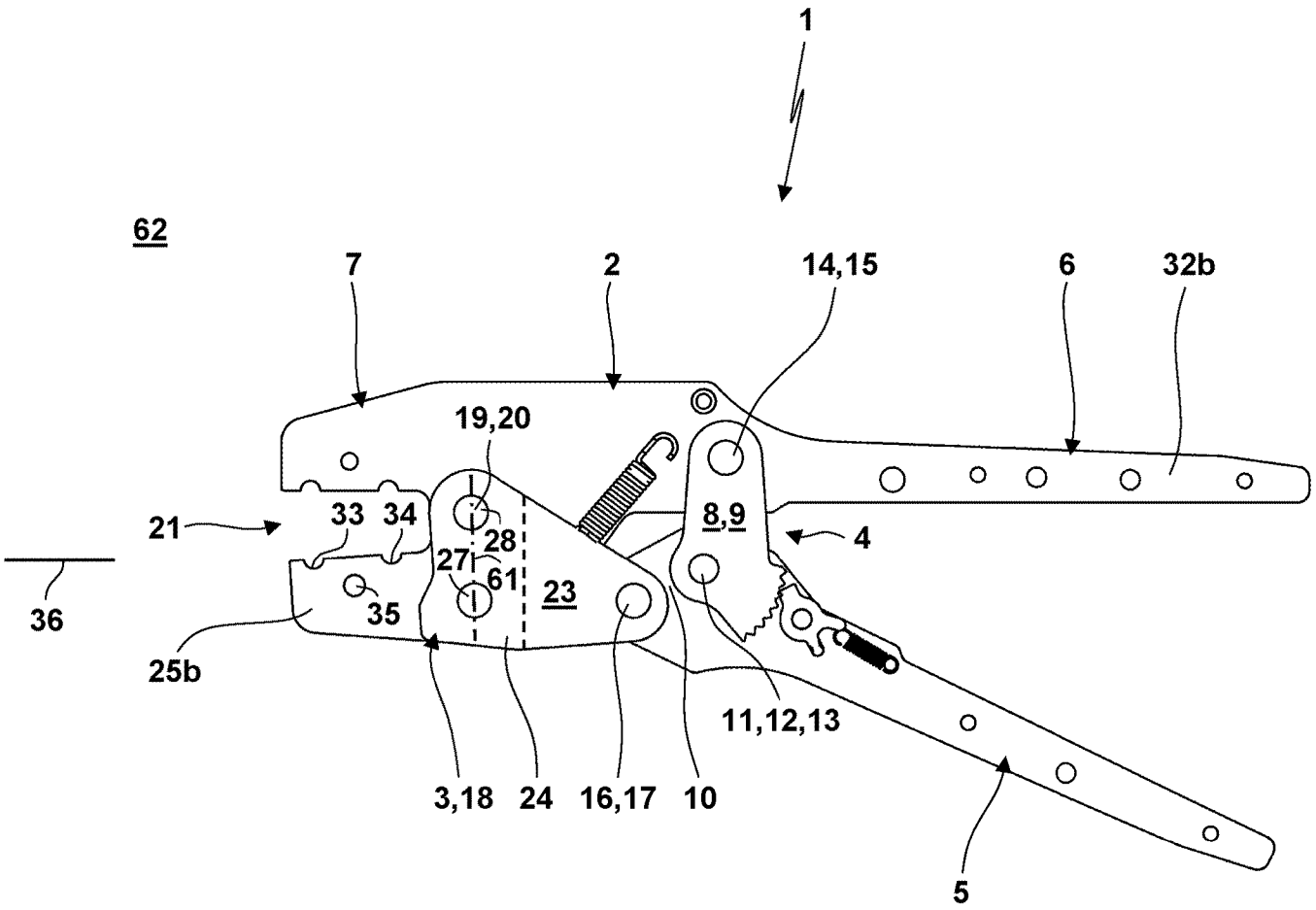
FIG. 3 shows crimping pliers modified according to the invention in a partially disassembled state and in a plan view onto the pliers head plane, the crimping pliers being in a partially opened operational state.
Figure 4:
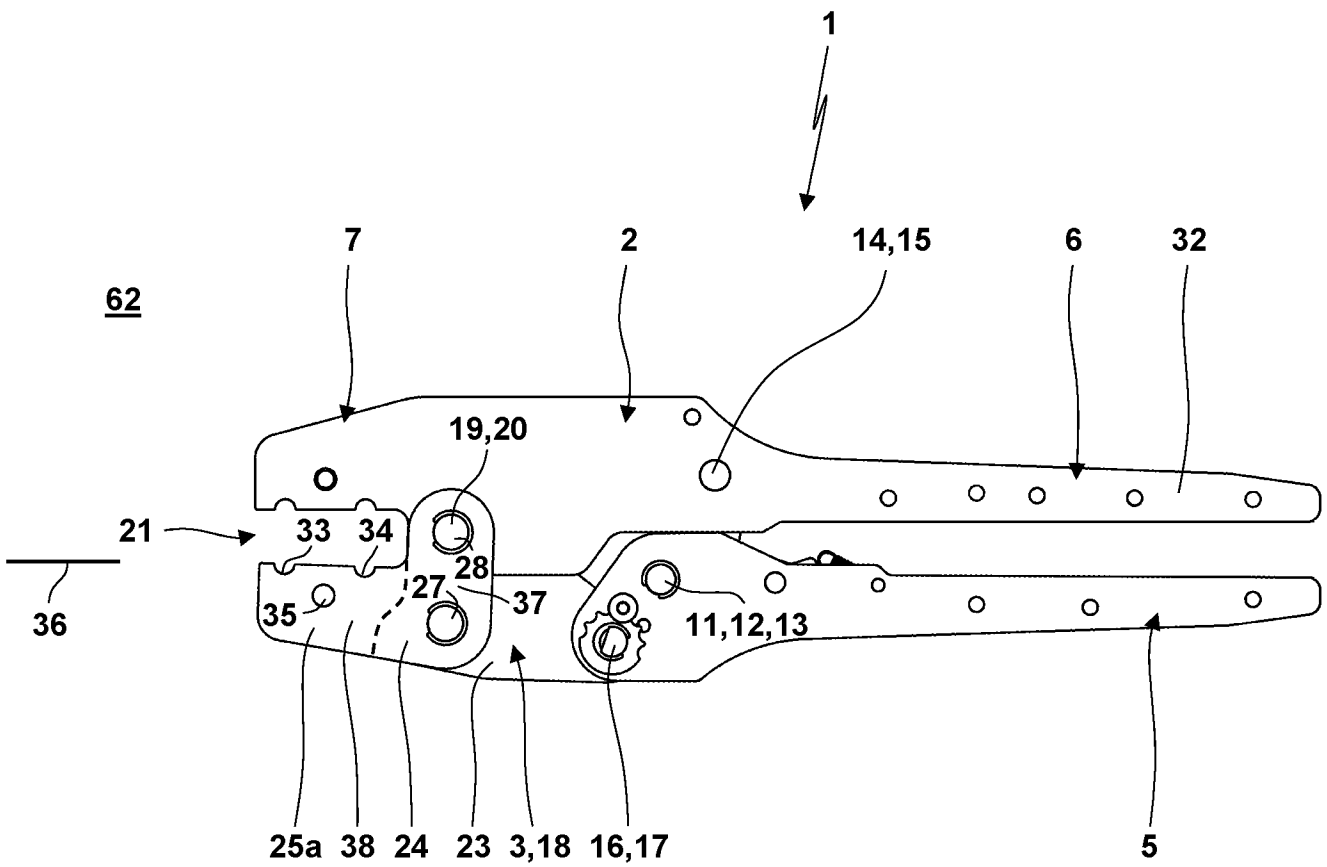
FIG. 4 shows the crimping pliers of FIG. 3 in an assembled state and in a plan view onto the pliers head plane, the crimping pliers being in a closed operational state.
Figure 5:
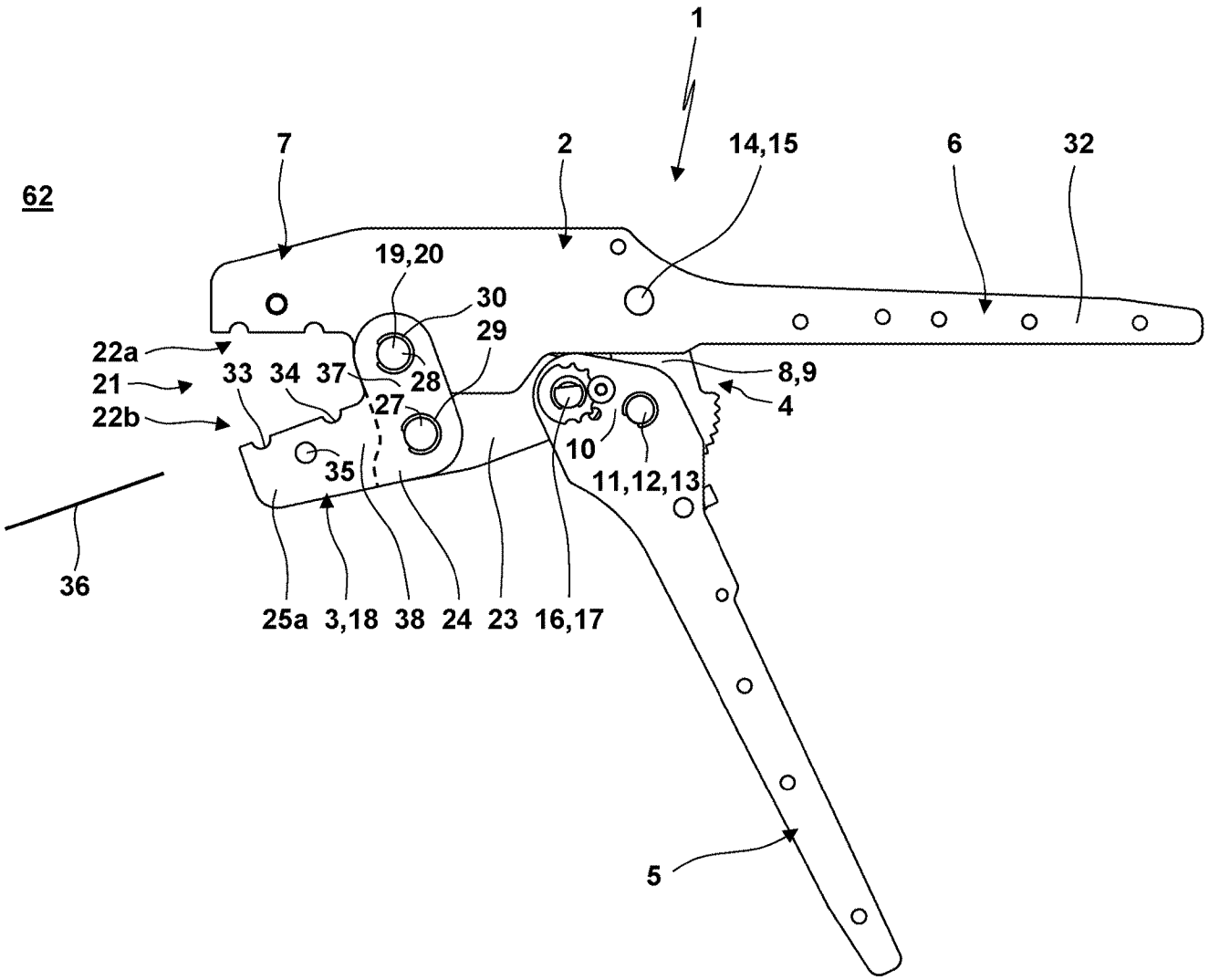
FIG. 5 shows the crimping pliers of FIGS. 3 and 4 in an assembled state and in a plan view onto the pliers head plane, the crimping pliers being in an opened operational state.

Without this necessarily being the case, for the embodiment of FIGS. 3 and 4 the second bolt 28 is not only used for mounting the pliers jaw plates 25*a*, 25*b* to the supporting plate 23. Instead, the second bolt 28 at the same time serves as pivot bolt 19 of the pivot joint 20. Accordingly, by means of the second bolt 28 also the pivoting degree of freedom of the pivoting pliers jaw 18 relative to the fixed pliers jaw 7 is provided. So, for the embodiment of FIGS. 3 to 6 it is possible to save one pivot bolt. In some cases it is also possible that the pivoting pliers jaw 18 has a shortened design which is due to the fact that a horizontal distance of the bolts 27, 28 as being provided in FIGS. 1 and 2 is not required.

For a simplified consideration the assumption is made that in FIG. 3 the horizontal distance of the point of introduction of the crimping force into the pivoting pliers jaw 18 from the first bolt 27 equals the distance of the bolts 27, 28 in vertical direction in FIG. 3. Under this assumption the bolts 27, 28 are each biased only by a bolt force that corresponds to the crimping force. Accordingly, by the inventive measures a mechanical bias of the bolts might result which is reduced when compared to the mechanical bias of the embodiments of FIGS. 1 and 2.

Figure 6:
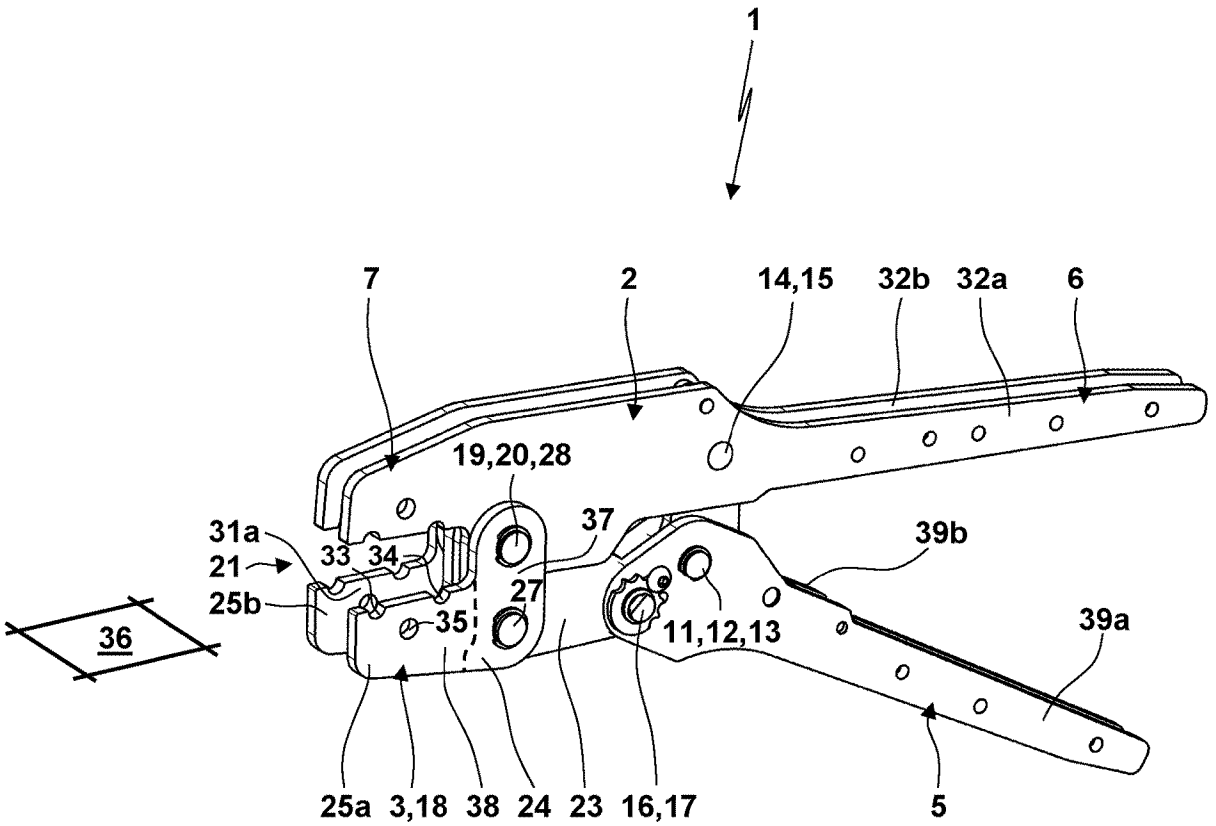
FIG. 6 shows the crimping pliers of FIGS. 3 to 5 in an assembled state and in a three-dimensional view, the crimping pliers being in a partially opened operational state.

In particular in FIG. 6 it can be seen that the two pliers jaw plates 25*a*, 25*b* are arranged in outer parallel planes whereas hand lever plates 39*a*, 39*b* of the movable hand lever 5 and the pliers part plates 32*a*, 32*b* of the fixed pliers part 2 are arranged between the parallel plates in adjacent parallel planes. The supporting plate 23 and the pressure lever 9 (which is here a part of a generally known forced locking unit) are again arranged in an intermediate space between the last mentioned planes.

Figure 7:
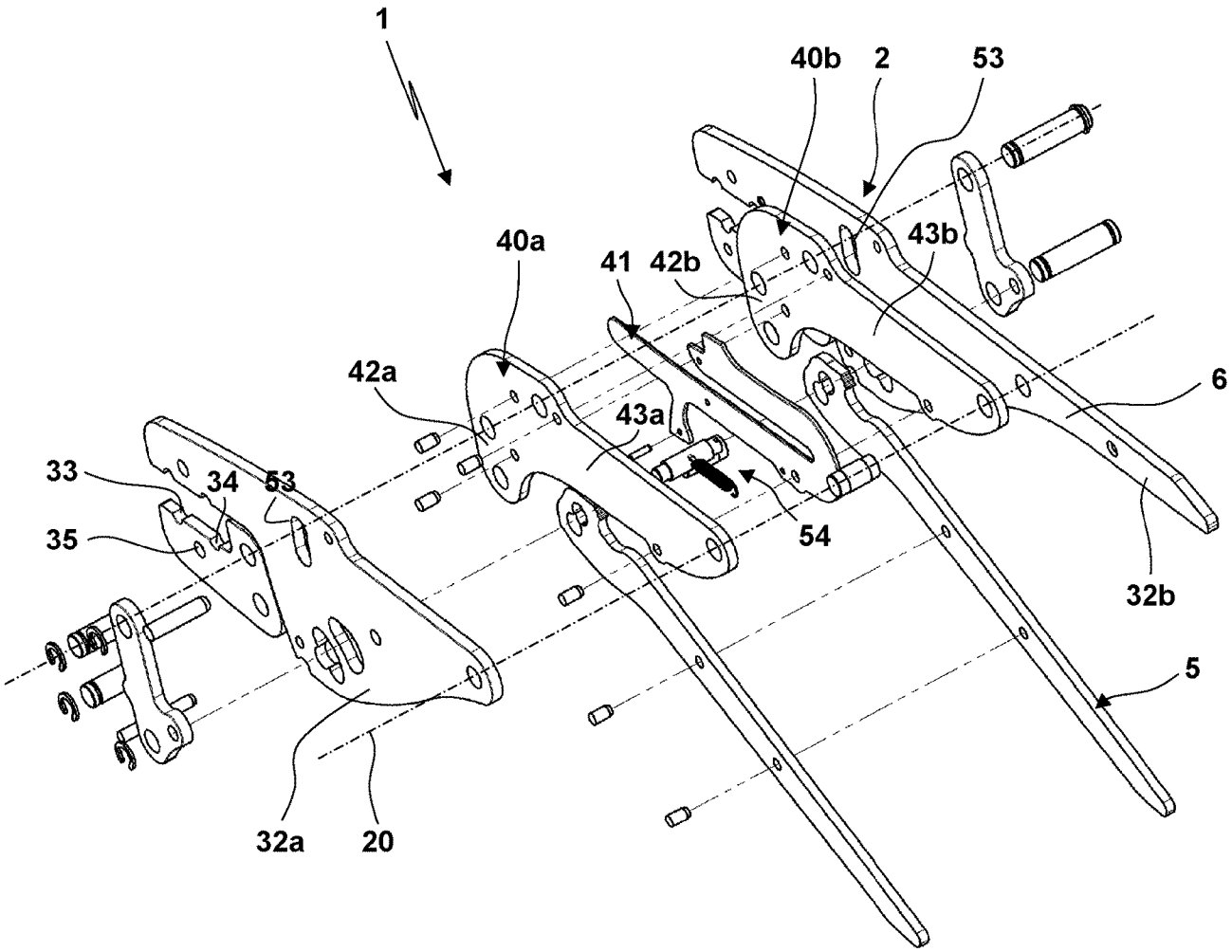
FIG. 7 shows a three-dimensional exploded view of another embodiment of crimping pliers.
Figure 8:
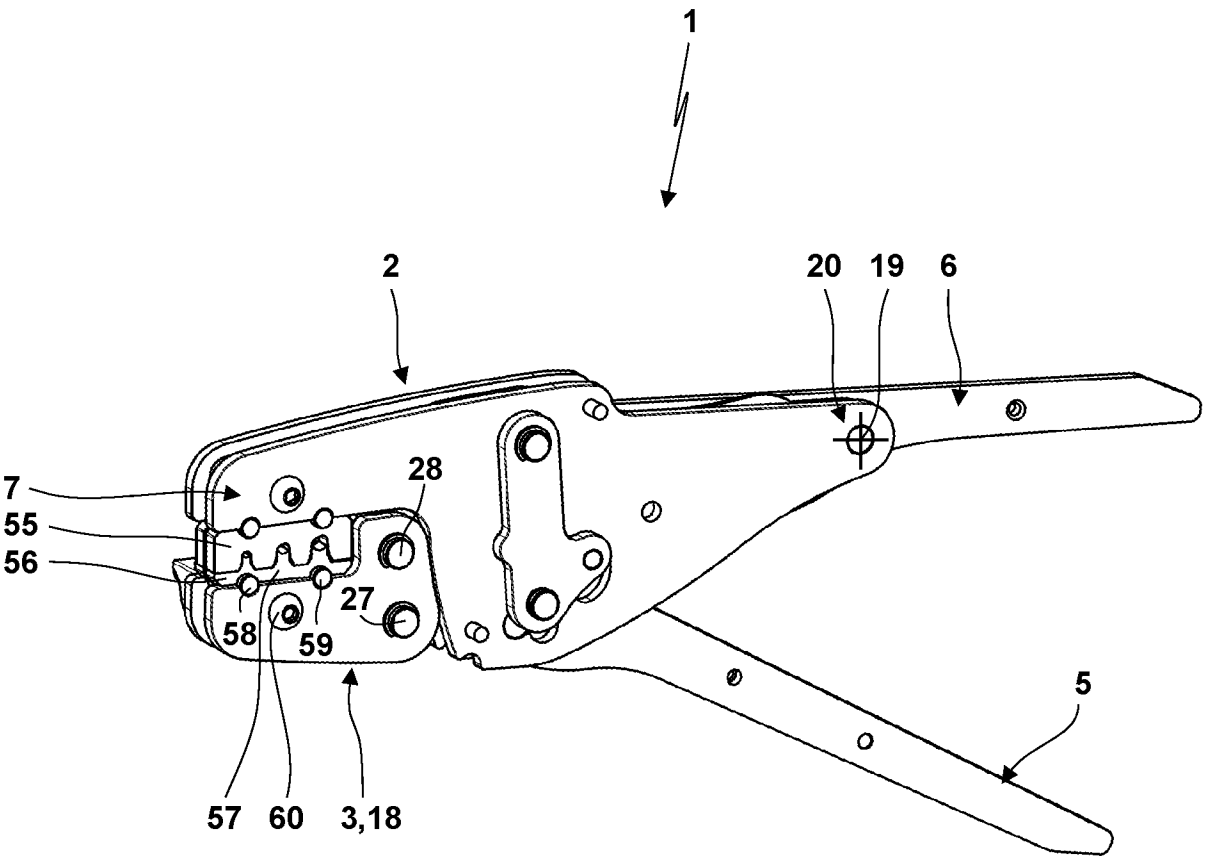
FIG. 8 shows a three-dimensional view of the crimping pliers of FIG. 7.
Figure 9:
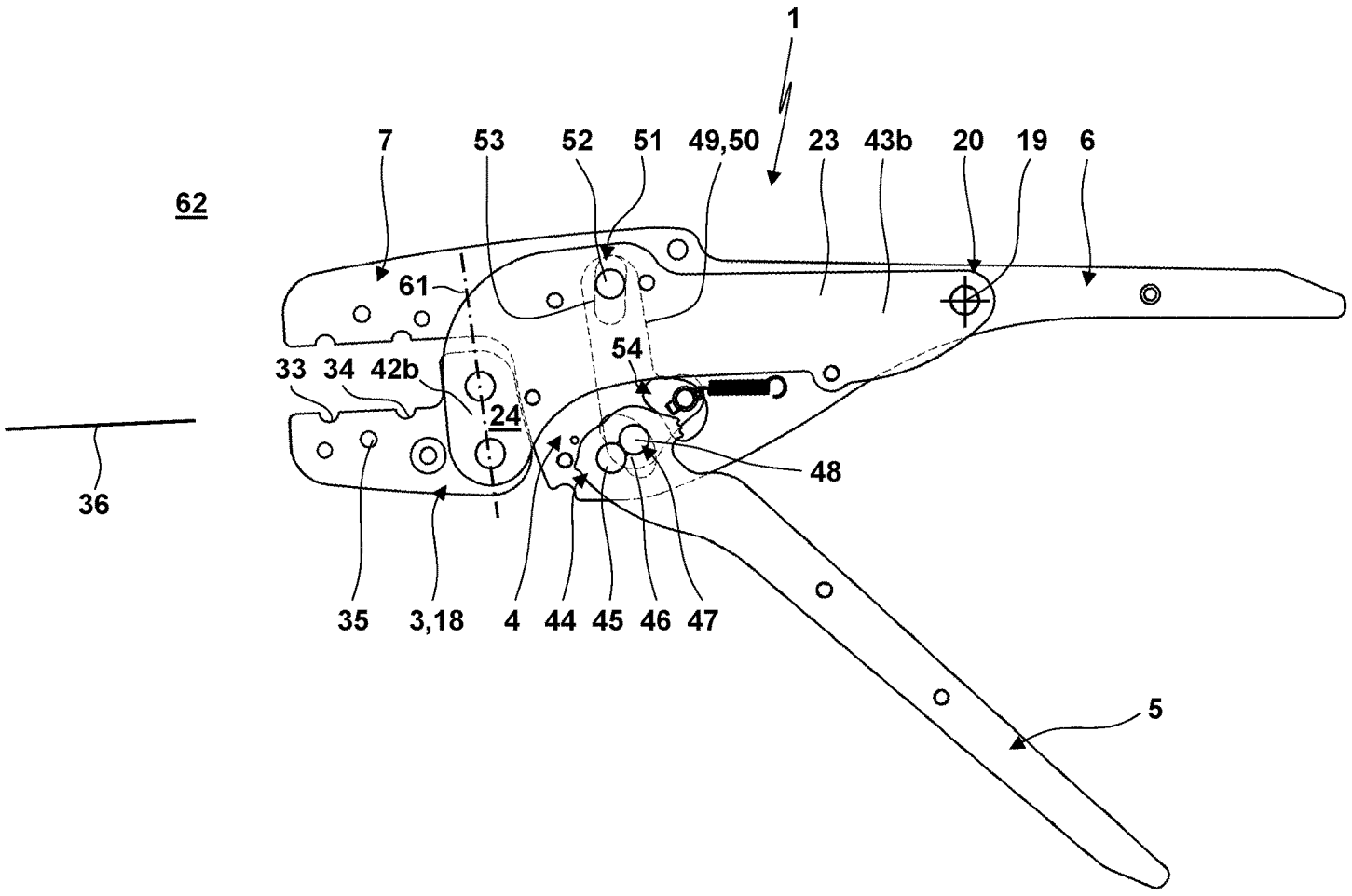
FIG. 9 shows the crimping pliers of FIGS. 7 and 8 in a plan view onto the pliers head plane in a partially disassembled state.

FIGS. 7 to 9 show another embodiment of inventive crimping pliers 1. Also here a pivoting pliers jaw 18 is supported by a pivot joint 20 for being pivoted by a fixed pliers part 2. However, here the pivot joint 20 is not arranged in the region of a pliers head of the crimping pliers 1, but in the region of the fixed hand lever 6 of the fixed pliers part 2. This embodiment leads to the consequence that in this case the supporting plate 23 comprises a larger extension in longitudinal direction of the crimping pliers 1. For this embodiment the supporting plate 23 comprises two plate-like supporting plate parts 40*a*, 40*b*. A spring element 41 is arranged between the supporting plate parts 40*a*, 40*b*. By the spring element 41 it is possible to influence the opening characteristic and closing characteristic of the crimping pliers and the force conditions during the opening movement and the closing movement.

For the shown embodiment the supporting plate 23 and the supporting plate parts 40*a*, 40*b* are L-shaped in a rough approximation. Here, the supporting plate parts 40*a*, 40*b* each comprise a mounting leg 42*a*, 42*b* and a pivoting arm leg 43*a*, 43*b*. The pivoting arm legs 43*a*, 43*b* in this case serve for bridging the distance of the pivot joint 20 from the pliers head. Instead, the mounting leg 42 serves for mounting the pliers jaw plates 25*a*, 25*b*. For this purpose in the region of the mounting leg 42*a*, 42*b* the overlaps 24*a*, 24*b* between the supporting plate parts 40*a*, 40*b* and the pliers jaw plates 25*a*, 25*b* are formed.

For the crimping pliers 1 of FIGS. 7 to 9 the toggle lever drive 4 has a design differing from the design of the embodiments toggle lever drive 4 of FIGS. 1 to 6: here the movable hand lever 5 is linked by a pivot joint 44 comprising a pivot bolt 45 at a fixed position, but for being pivoted to the fixed pliers part 2. One toggle lever 46 is formed by the movable hand lever 5 in the portion between the pivot joint 44 and a toggle joint 47. The toggle joint 47 comprises a pivot bolt 48. In the toggle joint 47 a toggle lever 49 which is a pressure lever 50 is linked to the movable hand lever 5. In the end region facing away from the toggle joint 47 the toggle lever 49 is linked by a pivot joint 51 comprising a pivot bolt 52 to the supporting plate 23. This linkage is provided (e.g. approximately in the middle) in the region of the pivoting arm leg 43*a*, 43*b* of the supporting plate parts 40*a*, 40*b*. Here, two pressure levers 50*a*, 50*b* are arranged outside from the pliers part plates 32*a*, 32*b*. The pivot bolts 52 are passed through elonged holes 53*a*, 53*b* of the pliers part plates 32*a*, 32*b*. The elonged holes 53*a*, 53*b* have a shape such that the elonged holes 53*a*, 53*b* do not interfere with the movement of the pivot bolt 52 over the crimping stroke. Furthermore, it can be seen that the crimping pliers 1 of FIGS. 7 to 9 comprise a forced locking unit 54.

For the shown embodiment in a plan view onto the pliers head plane the pivoting pliers jaw 18 comprises an approximately Z-shaped geometry. Between the two horizontal legs of the Z the connecting leg has a vertical orientation. Accordingly, the two horizontal legs of the Z have an offset in the longitudinal direction of the crimping pliers 1 without an overlap of the same in longitudinal direction. Here, the lower horizontal leg of the Z is formed by the pliers jaw legs 38 of the pliers jaw plates 25. The connecting leg of the Z is formed both by the mounting leg 37 of the pliers jaw plates 25 as well as by the mounting legs 42 of the supporting plate parts 40. The upper horizontal leg of the Z is formed by the pivoting arm leg 43 of the supporting plate parts 40.

In FIG. 8 die inserts 55, 56 are inserted into the accommodations 22*a*, 22*b* of the fixed pliers jaw 7 and the pivoting pliers jaw 18. The die inserts 55, 56 comprise supporting elements 58, 59. The supporting elements 58, 59 are embodied as transverse bolts. The supporting elements 58, 59 protrude on both sides from a die plate 57. The die inserts 55, 56 are arranged and supported with or by the supporting element 58, 59 in the concave accommodations 33, 34. Furthermore, the die inserts 55, 56 are additionally screwed by a mounting screw 60 in the region of the mounting bore 35.

For the two embodiments in FIGS. 1 and 9 a connecting axis of the longitudinal axes of the bolts 27, 28 is denoted with the reference numeral 61. For the inventive embodiment the angle between this connecting axis 61 and the supporting plane 36 is preferably 90°±30° e.g. 90°±20° or 90°±10° or 90°±5°.

In the Figures a pliers head plane denotes a plane wherein the pivoting pliers jaw 18 is pivoted. Here, the pliers head plane 62 corresponds to the drawing planes of FIG. 1, FIG. 3, FIG. 4, FIG. 5 and FIG. 9 or the pliers head plane 62 has an orientation parallel to these drawing planes.

With respect to further details of the embodiment of the crimping pliers 1 of FIGS. 7 to 9 (in particular with respect to the design and the interaction of the spring element 41 for influencing the force conditions and the opening characteristic and the closing characteristic of the crimping pliers 1) reference is made to the European patent application with the application number EP 18 166 729.6 which is filed by the applicant of the present European patent application on the same date as the present European patent application. The disclosure of this simultaneously filed to European patent application is introduced by reference into the present application.

Within the present specification constructional elements corresponding or being similar with respect to the function and/or the design are partly denoted with the same reference numerals but denoted with an additional distinguishing letter a, b, . . . . Reference is also made to these constructional elements partly without use of the additional letter.

Many variations and modifications may be made to the preferred embodiments of the invention without departing substantially from the spirit and principles of the invention. All such modifications and variations are intended to be included herein within the scope of the present invention, as defined by the following claims.

We claim:

1. A pivoting pliers jaw comprising
- a) a supporting plate and
- b) a pliers jaw plate, which
  - ba) forms or supports at least one accommodation for a die insert,
  - bb) defines a supporting plane of the at least one accommodation for supporting a crimping force biasing the die insert,
  - bc) is arranged with an overlap on one side of the supporting plate and
  - bd) is fixed in a region of the overlap by a first bolt and a second bolt at the supporting plate,
- c) an angle between
  - a connecting axis of longitudinal axes of the first bolt and the second bolt and
  - the supporting plane in a pliers head plane being 90°±30°,
- d) the pliers jaw plate comprising a mounting leg and a pliers jaw leg, the mounting leg and the pliers jaw leg being arranged in an L-shape and
- e) the first bolt extending through a transitional region where the mounting leg transits to the pliers jaw leg and/or the second bolt extending through a free end region of the mounting leg.

2. The pivoting pliers jaw of claim 1 wherein the second bolt is a pivot bolt.

3. The pivoting pliers jaw of claim 1 wherein the at least one accommodation of the pliers jaw plate comprises
- a) two accommodations for supporting elements of a die insert which are arranged with a distance in a projection onto the supporting plane and by which at least a component of a crimping force biasing the die insert and having an orientation perpendicular to the supporting plane can be transferred from the die insert to the pliers jaw plate and/or
- b) a bore for a mounting screw by which it is possible to mount the die insert to the pliers jaw plate.

4. The pivoting pliers jaw of claim 1 wherein by the first bolt and the second bolt, the pliers jaw plate and a second pliers jaw plate are held on different sides of the supporting plate.

5. The pivoting pliers jaw of claim 4 wherein a thickness of the supporting plate in a region of the overlap equals a thickness of an accommodating space formed between the pliers jaw plates into which a die insert can be inserted.

6. Crimping pliers comprising a pivoting pliers jaw having a design comprising plates, the pivoting pliers jaw comprising a) a supporting plate and b) a pliers jaw plate, which ba) forms or supports an accommodation for a die insert, bb) defines a supporting plane of the accommodation for supporting a crimping force biasing the die insert, bc) is arranged with an overlap on one side of the supporting plate and bd) is fixed in a region of the overlap by a first bolt and a second bolt at the supporting plate, c) an angle between a connecting axis of longitudinal axes of the first bolt and the second bolt and the supporting plane in a pliers head plane being 90°±30°, d) the pliers jaw plate comprising a mounting leg and a pliers jaw leg, the mounting leg and the pliers jaw leg being arranged in an L-shape and e) the first bolt extending through a transitional region where the mounting leg transits to the pliers jaw leg and/or the second bolt extending through a free end region of the mounting leg, the crimping pliers further comprising a toggle lever drive actuated by hand levers or a drive, one toggle lever of the toggle lever drive being linked to the supporting plate.

7. The crimping pliers of claim 6 wherein the second bolt is a pivot bolt of the crimping pliers which supports the pivoting pliers jaw for being pivoted at a fixed pliers jaw, a pliers head or a fixed pliers part.

* * * * *